US005466989A

United States Patent [19]

Sato et al.

[11] Patent Number: 5,466,989

[45] Date of Patent: Nov. 14, 1995

[54] DISCHARGE TUBE

[75] Inventors: Takashi Sato; Takahisa Suzuki; Hiromitsu Tsuchiya; Tetsuya Mitani, all of Shizuoka, Japan

[73] Assignee: Yazaki Corporation, Tokyo, Japan

[21] Appl. No.: 183,291

[22] Filed: Jan. 19, 1994

Related U.S. Application Data

[63] Continuation-in-part of Ser. No. 127,275, Sep. 27, 1993.

[30] Foreign Application Priority Data

Jan. 20, 1993 [JP] Japan ..... 5-001086

[51] Int. Cl.[6] ..... H01J 61/35

[52] U.S. Cl. ..... 313/635; 313/325; 361/120

[58] Field of Search ..... 313/635, 589, 313/325; 361/120

[56] References Cited

U.S. PATENT DOCUMENTS 5,103,135 4/1992 Lange et al. ..... 313/635

5,235,247 8/1993 Shishido et al. ..... 313/325 X

FOREIGN PATENT DOCUMENTS 3-68389 7/1991 Japan .

4-133244 5/1992 Japan .

*Primary Examiner*—Donald J. Yusko

*Assistant Examiner*—N. D. Patel

*Attorney, Agent, or Firm*—Nikaido, Marmelstein, Murray & Oram

[57] ABSTRACT

A discharge tube according to the present invention is constructed such that it includes a cylindrical container made of an insulation tube, a pair of discharge electrodes provided at opposite ends of the container, a plurality of insulation coated lines containing a gas-ionization accelerator therein, which insulation coated lines being provided in the grooves formed on the inner surface of the container covering the regions surrounding a cathode and a discharge space therein in a substantially same distance from a center axis of the container, wherein the container further comprises a flange portion formed at the cathode-side thereof in such a way that it protrudes inwardly, and the insulation coated lines are provided on the inner surface of the container except the inner side of the flange portion. The discharge tube as constructed above shows a stabilized discharge inception characteristics regardless of the frequency of repetitive discharge, and is also capable of avoiding an inner creeping discharge even when the discharge is repeated for a long time, yet providing a constant life time.

4 Claims, 4 Drawing Sheets

DISCHARGE TUBE

CROSS REFERENCE TO RELATED APPLICATION

This application is a continuation-in-part of application Ser. No. 08/127,275, filed Sep. 27, 1993.

BACKGROUND OF THE INVENTION

1. Field of the Invention

The present invention relates to a discharge tube, and more particularly to a discharge tube having a stabilized discharge inception characteristics suitably used for a voltage controller, a gap switch, a sharpener gap and so on.

2. Description of the Related Art

Generally, a discharge tube is adopted in a voltage controlling device, or in a gap switch for correctly controlling a discharge inception of a pulse laser or the like, and as a discharge tube suitable for this purpose there has been provided a discharge tube which comprises a cylindrical container made of an insulation tube provided with a pair of discharge electrodes at opposite sides thereof, and having an inert gas sealed therein.

The discharge tube as constructed above in general has a tendency that when the frequency of repetitive discharge becomes low, a discharge inception is delayed and a discharge inception voltage is thereby raised. However, it is not desirable that the discharge inception voltage varies according to the discharge frequency, and in fact, a discharge inception voltage in a discharge tube should be stabilized regardless of the above frequency of repetitive discharge.

In view of these defects to be overcome, there has been invented a discharge tube which is capable of accelerating an inception of the main discharge by providing trigger lines made of conductive layers or the like respectively extending from opposite electrodes on the inner surface of a cylindrical container which is a main body of the discharge tube. However, in the discharge tube as constructed above, when the discharge is repeated for a long time, the trigger lines are worn and thereby the trigger effect thereof does not last long, and in addition, an abnormal discharge creeping, that is, so called an inner creeping discharge along the inner surface of the cylindrical container is likely to occur.

In view of the above phenomena, there has also been proposed a discharge tube which is capable of accelerating a preionization of the gas sealed in a discharge space thereof, avoiding thereby the delay of an inception of discharge even when the frequency of repetitive discharge is substantially low by dispersively building up a small amount of electrically conductive substance on the inner surface of the cylindrical container (as shown in Japanese Utility Model Application Laid-open No. 3-68389), or, for example as shown in FIG. 8A, by coating an insulation coating substance containing a gas-ionization accelerator such as a silicate compound of alkaline metal on the inner surface of the cylinder (as shown in Japanese Patent Application Laid-open No. 4-133244). However, even a discharge tube as constructed above could not perfectly solve such a problem that the inner creeping discharge is more likely to occur in proportion to the cumulative number of discharge, in spite of the fact that it is provided with a stabilized discharge inception.

Under these circumstances, the applicants of the present invention have found out the fact that a discharge tube as shown in FIG. 8B, which is constructed such that a plurality of insulation coated lines 3 containing a gas-ionization accelerator therein are provided on the inner surface of a cylindrical container 1 in such a way that they cover the regions surrounding a cathode 4 and a discharge space formed between the cathode 4 and anode 5 in a substantially parallel relation with a center axis of the cylindrical container 1, has a stabilized discharge inception characteristics regardless of the frequency of repetitive discharge or of the cumulative number of discharge, yet capable of eliminating an occurrence of inner creeping discharge, and accordingly the applicants have filed a Japanese Utility Model Application (Laid-open No. 4-69539). However, even though a discharge tube as constructed above could suppress an inner creeping discharge better than the conventional ones, it has still been a difficult problem to control the length and width of the insulation coated lines 3 of each electrode into a constantly same size to provide a stabilized life time to all the tubes.

The present invention has been made to eliminate such problems, and it is an object of the present invention to provide a discharge tube which has a stabilized discharge inception characteristics regardless of the frequency of repetitive discharge or of the cumulative number of discharge, and is also capable of eliminating an occurrence of inner creeping discharge, yet having a constant life time.

SUMMARY OF THE INVENTION

In order to accomplish the above object, an electric discharge tube according to the present invention is constructed such that it comprises a cylindrical container made of an insulation tube, a pair of discharge electrodes provided at opposite ends of the container, a plurality of insulation coated lines containing a gas-ionization accelerator therein, which insulation coated lines being provided in the grooves formed on the inner surface of the container covering the regions surrounding a cathode and a discharge space therein in a substantially same distance with respect to a center axis of the container.

The discharge tube according to the present invention is further constructed such that it comprises a flange portion formed at the cathode-side end of the container in such a way that it protrudes inwardly, and a plurality of insulation coated lines containing a gas-ionization accelerator therein, which insulation coated lines being provided on the inner surface of the container except the inner side of the flange portion. The discharge tube constructed as such can have a better effect.

By the way, the insulation coated lines provided on the inner surface of the container includes a gas-ionization accelerator, which is made of a silicate powder selected from the group of alkaline metal and alkaline earth metal.

A discharge tube according to the present invention has a stabilized discharge inception characteristic regardless of the frequency of repetitive discharge, and is also capable of avoiding an inner creeping discharge even when the discharge is repeated for a long time, yet each one having a constant life time.

BRIEF DESCRIPTION OF THE DRAWINGS

The present invention becomes more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

In the following, several embodiments of the present invention are described with reference to the accompanying drawings.

Figure 1A:
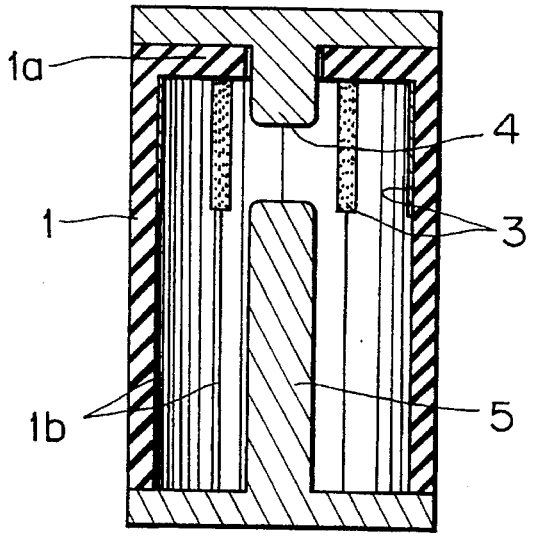
FIGS. 1A and 1B are sectional views showing the structure of a discharge tube A of the present invention.
Figure 1B:
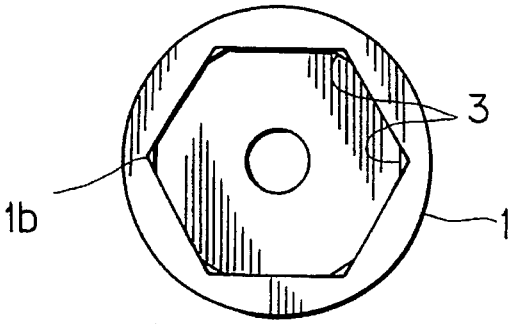

FIGS. 1A and 1B are illustrations showing a structure of the discharge tube A as a first embodiment of the present invention. In these figures, there is shown a cylindrical container 1 with a vertical length of 17 mm, which is formed of an electrically insulating material such as ceramics (hereinafter referred to just as a cylinder or a container) and having an external surface formed in a cylindrical shape and an inner surface formed in an equilateral hexagonal shape, respectively having a diameter of 10 mm and a diagonal of 7.5 mm, wherein a flange 1*a* having a width of 1.5 mm is inwardly protruded at one end thereof forming a hole of 3.5 mm diameter, In the cylindrical container as constructed above, a coating compound which is a mixture of water and silicate glass powder of barium soda (which is a product of NIHON DENKI GLASS with a product number ST-W/K) is coated for about 1 mm width and extending to a length of 5 mm from the inner side of the flange 1*a* and dried to form six insulation coated lines 3 in each of six triangle grooves 1*b* formed in parallel to each other, and thereafter a cylindrical cathode 4 having an external diameter of 3 mm and a vertical length of 3 mm is inserted through the hole made by the flange 1*a*, while a cylindrical anode 5 having an external diameter of 3 mm and a vertical length of 11 mm is inserted from the other end of the container and fixed in such a way that the both electrodes are disposed in a face-to-face relation with a mutual distance of 3 mm therebetween, whereafter argon gas is injected to a pressure of 9 atm. and sealed therein.

Figure 2:
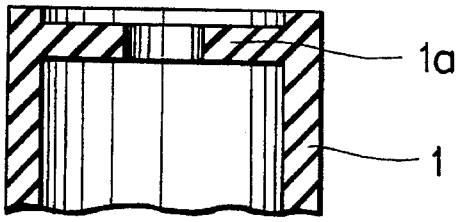
FIG. 2 is a sectional view showing the structure of a flange portion used in a discharge tube B of the present invention.

FIG. 2 is an illustration showing a structure of the discharge tube B as a second embodiment of the present invention. In the same figure, there is shown a cylindrical ceramic container 1 having exactly the same structure as the discharge tube A except that the flange 1*a* is shifted for 0.25 mm toward the anode side from one end of the container 1, and a coating compound which is a-mixture of a compound substance of 5 parts of alumina impalpable powder and 1 part of carbon black and water containing 20% of alcohol is coated and dried to make the coated lines 3. Otherwise, all other structural elements to obtain the tube B are same as those for obtaining the discharge tube A.

Figure 3:
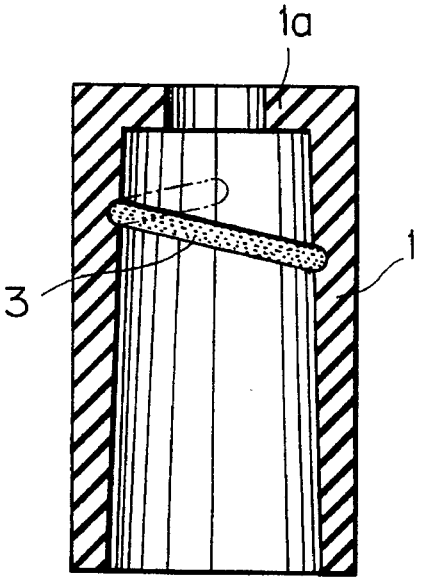
FIG. 3 is a sectional view showing the structure of a container used in a discharge tube C of the present invention.

A discharge tube C is shown in FIG. 3 as a third embodiment of the present invention, in which a cylindrical ceramic container 1 has the same structure as the discharge tube A except that the inner surface thereof is formed rather in a cone shape such that an inner diameter thereof at the inner side of the flange 1*a* is 6.5 mm, and that at the other open end is 7.5 mm, wherein a spiral groove 1*b* is formed such that it starts from a position 2 mm away from the inner side of the flange 1*a*, making one round, and ends at a position 5 mm away from the same, in which an insulation coated line 3 is formed. Otherwise, all other structural elements are same as those for obtaining the discharge tube A.

Figure 4A:
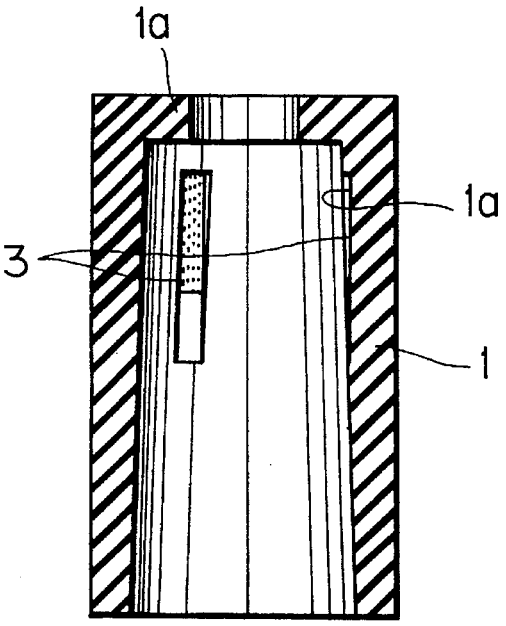
FIGS. 4A and 4B are sectional views showing the structure of a container used in a discharge tube D of the present invention.
Figure 4B:
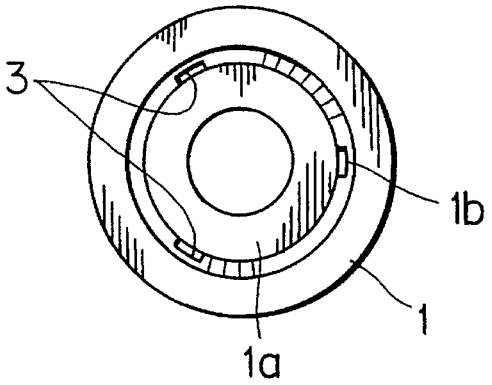

A discharge tube D is shown in FIGS. 4A and 4B as a fourth embodiment of the present invention, in which a cylindrical ceramic container 1 has the same structure as the discharge tube A, except that the inner surface thereof is formed in the same shape as the discharge tube C, wherein three square grooves 1*b*, each having the width of 2 mm, are formed on the inner surface of the container such that each one starts at a position about 1 mm away from the inner side of the flange 1*a* extending towards the other open end, and that the bottom of each groove has 3.4 mm distance from the center axis of the container, mutually making an angle of 120° from one another, in which insulation coated lines 3 are formed. Otherwise, all other structural elements are same as those for obtaining the discharge tube A.

Figure 5A:
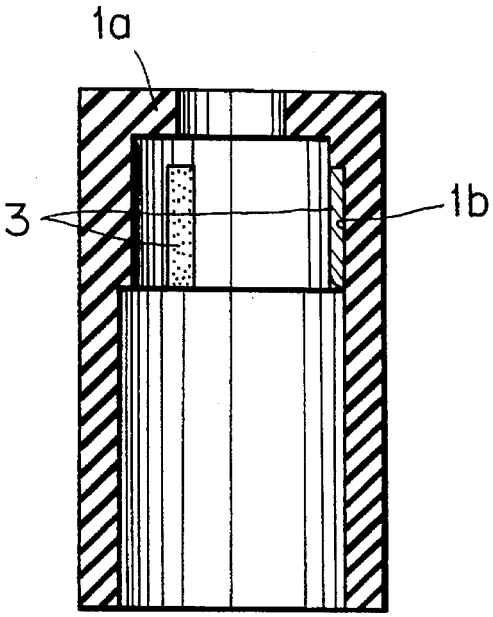
FIGS. 5A and 5B are sectional views showing the structure of a container used in a discharge tube E of the present invention.
Figure 5B:
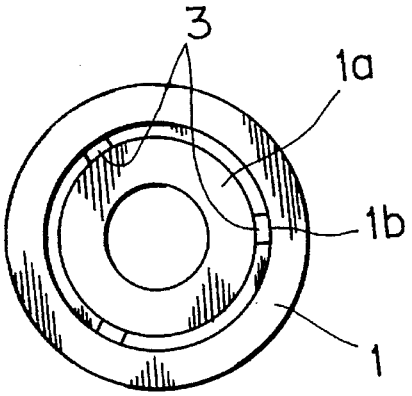

A discharge tube E is shown in FIGS. 5A and 5B as a fifth embodiment of the present invention, in which a cylindrical ceramic container 1 has the same structure as the discharge tube A, except that the inner surface thereof is in a cylindrical shape up to a position about 5 mm away from the inner side of the flange 1*a* having 6.5 mm in diameter wherein there are formed three square grooves 1*b* starting from a position about 1 mm away from the inner side of the flange 1*a*, each of which having a width 2 mm and a depth of 0.5 mm, and insulation coated lines are formed therein in such a way that they mutually make an angle of 120° from one another, and that there is also formed another cylindrical surface of 7.5 mm diameter which starts from a position about 5 mm away from the inner side of the flange 1*a* extending toward the open end at the other end. Otherwise, all other structural elements are same as those for obtaining the discharge tube A.

Figure 6A:
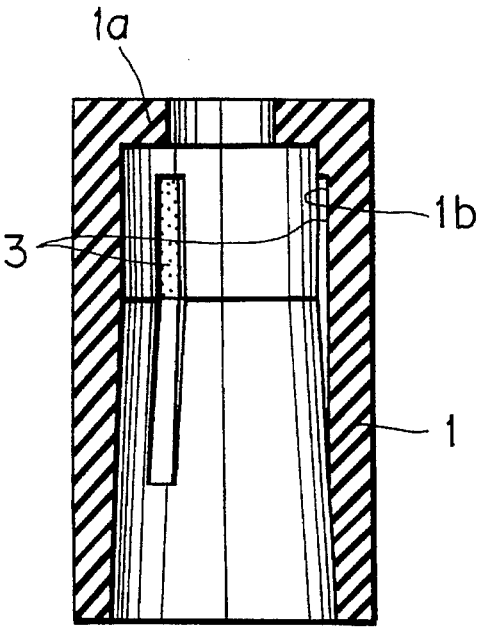
FIGS. 6A and 6B are sectional views showing the structure of a container used in a discharge tube F of the present invention.
Figure 6B:
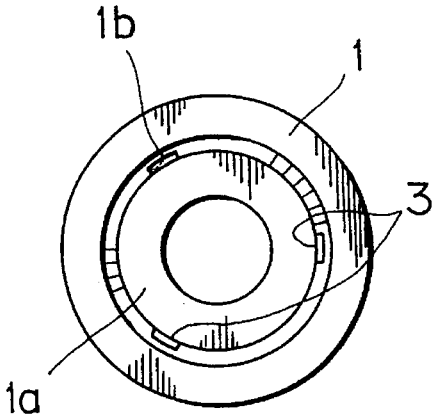

A discharge tube F is shown in FIGS. 6A and 6B as a sixth embodiment of the present invention, in which a cylindrical ceramic container 1 has the same structure as the discharge tube A, except that the inner surface thereof is in a cylindrical shape up to a position about 5 mm away from the inner side of the flange 1*a* having the same structure as that of the fifth embodiment, and that there is also formed a cone surface which starts from the position about 5 mm away from the inner side of the flange 1*a* toward the open end having a diameter of 7.5 mm, wherein three square grooves 1*b* having the width of 2 mm are formed such that each one starts at a position about 1 mm away from the inner side of the flange 1*a* extending towards the open end, and that the bottom of each groove has 3.4 mm distance from the center axis of the container, mutually making an angle of 120° from one another, in which insulation coated lines 3 are formed. Otherwise, all other structural elements are same as those for obtaining the discharge tube A.

Figure 7A:
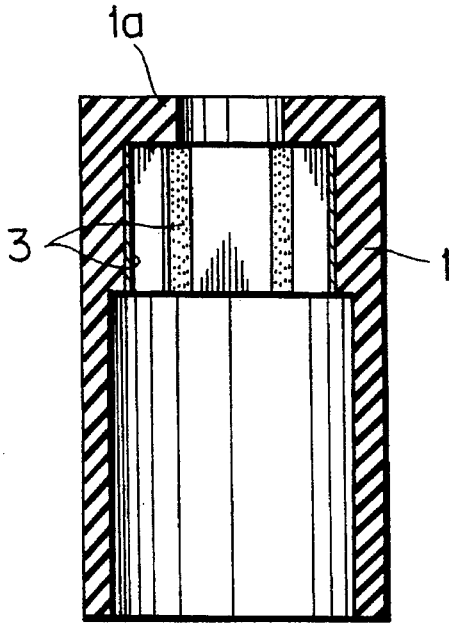
FIGS. 7A and 7B are sectional views showing the structure of a container used in a discharge tube G of the present invention.
Figure 7B:
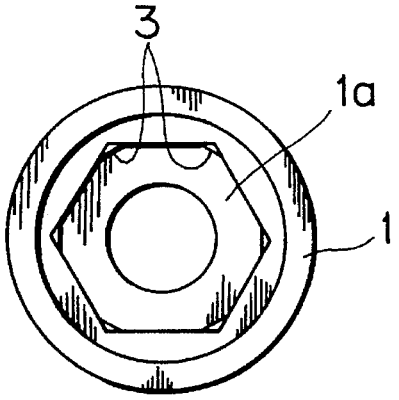

A discharge tube G is shown in FIGS. 7A and 7B as a seventh embodiment of the present invention, in which a cylindrical ceramic container 1 has the same structure as the discharge tube A, except that although the inner surface thereof is formed in an equilateral hexagonal shape as that of the discharge tube A up to about 5 mm away from the inner surface of the flange 1*a*, it is also formed in a cylindrical shape with 8.0 mm diameter extending therefrom toward the open end, wherein insulation coated lines are formed in the triangle grooves. Otherwise, all other structural elements are same as those for obtaining the discharge tube A.

[Comparison]

Figure 8A:
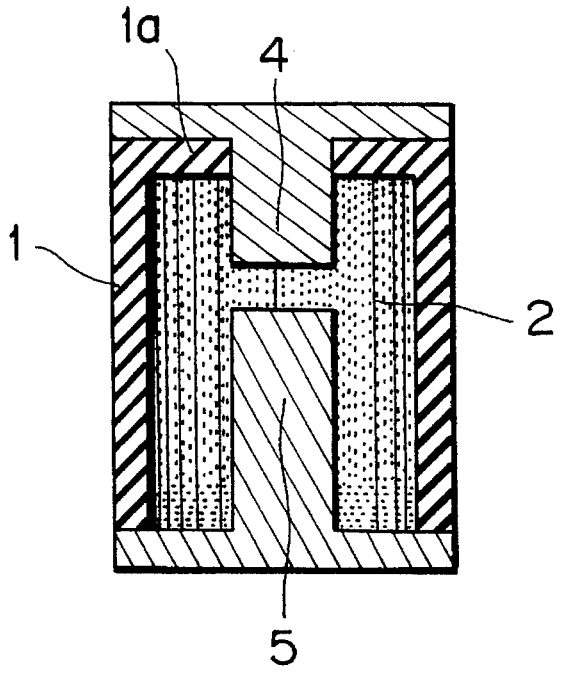
FIG. 8A PRIOR ART
FIG. 8A is a sectional view showing a conventionally used discharge tube using a gas-ionization accelerator.
Figure 8B:
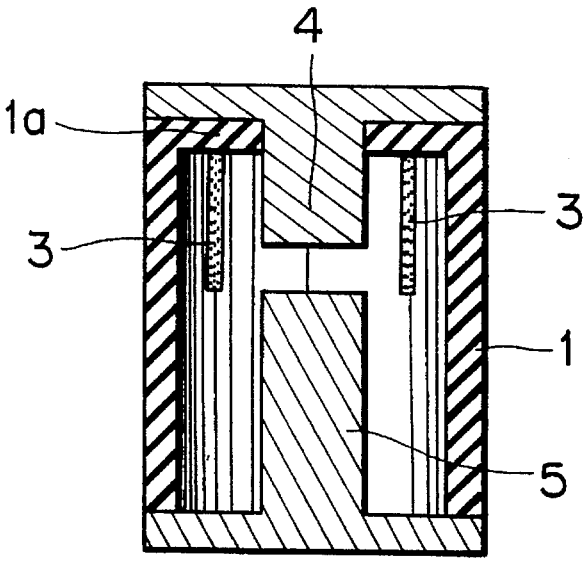
FIG. 8B PRIOR ART
FIG. 8B is a sectional view showing a technically improved conventional discharge tube H to be compared with the discharge tubes of the present invention.

FIG. 8B is an illustration showing a structure of the discharge tube H to be compared with these discharge tubes of the present invention.

As shown in the same figure, a cylindrical ceramic container 1, whose vertical length is 17 mm and whose cylindrical external and internal surfaces are respectively 10 mm and 7.5 mm in diameter, is constructed such that a flange 1*b* having a width of 1.5 mm and a length of 2.0 mm is protrudedly formed at one end of the container 1, wherein there are also formed three insulation coated lines 3 on the inner surface of the container 1, each having a width of 2.0 mm and extending to a length of 5 mm from the inner side of the flange 1*a* such that they mutually form 120° from one another. Otherwise, all other procedures are same as those for obtaining the discharge tube A.

[Experiment]

In the experiment, ten discharge tubes per each of the above types are examined in such a way that the anode side is grounded and a minus high voltage of a repetitive frequency of 0.2 Hz is applied to the cathode to make a discharge, and thereafter the occurrence of inner creeping discharge with respect to each case is examined. As a result, as to the discharge tube H, the life time of those ten tubes, which means until a discharge in a low voltage begins to occur due to the inner creeping discharge, varied from 40,000,000 to 150,000,000 times of cumulative discharge, while that of all the tubes of A to G types was more than 150,000,000 times, yet having a stabilized discharge inception voltage, and no inner creeping discharge has occurred.

[Effect of the Invention]

Since a discharge tube of the present invention is constructed such that it is provided with a plurality of insulation coated lines containing a gas-ionization accelerator therein in the grooves formed on the inner surface of the container, it shows a stabilized discharge inception characteristic regardless of the frequency of repetitive discharge, and is also capable of avoiding an inner creeping discharge even when the discharge is repeated for a long time, yet each one having a constant life time.

While the invention has been described with reference to specific embodiments, the description is illustrative and is not construed as limiting the scope of the invention. Various modifications and changes may occur to those skilled in the art without departing from the spirit and scope of the invention as defined by the appended claims.

What is claimed is:

1. A discharge tube comprising:

a cylinder made of an insulation tube;

a pair of discharge electrodes provided at opposite ends of said cylinder, one of said electrodes being an anode and the other of said electrode being a cathode;

a plurality of grooves formed on the inner surface of said cylinder around the regions surrounding said cathode and a discharge space within said cylinder; and a plurality of insulation coated lines containing a gas-ionization accelerator therein formed in each of said grooves, said insulation coated lines being provided in a substantially same distance with respect to a center axis of said cylinder.

2. A discharge tube as claimed in claim 1, wherein said cylinder further comprises a flange portion at the cathode side thereof, said flange portion being protruded inwardly to make a hole through which said cathode is inserted to an inner side of said cylinder, wherein said plurality of insulation coated lines are not provided on the inner surface of said flange portion.

3. A discharge tube as claimed in claim 2, wherein said plurality of insulation coated lines are formed in such a form as starting at a certain distance from said flange portion and extending in the direction toward the other end of said cylinder.

4. A discharge tube as claimed in claim 1, wherein said gas-ionization accelerator is made of a silicate powder selected from the group of alkaline metal and alkaline earth metal.

* * * * *